US005687549A

United States Patent [19]

Jostler et al.

[11] Patent Number: 5,687,549

[45] Date of Patent: Nov. 18, 1997

[54] METHOD AND AN APPARATUS FOR FORMING AND FILLING PACKAGES

[75] Inventors: Jan Jostler; Ingemar Broden, both of Halmstad, Sweden

[73] Assignee: Joker System Aktiebolag, Halmstad, Sweden

[21] Appl. No.: 553,511

[22] PCT Filed: May 5, 1994

[86] PCT No.: PCT/SE94/00417

§ 371 Date: Nov. 3, 1995

§ 102(e) Date: Nov. 3, 1995

[87] PCT Pub. No.: WO94/25345

PCT Pub. Date: Nov. 10, 1994

[30] Foreign Application Priority Data

May 5, 1993 [SE] Sweden ..... 9301560

[51] Int. Cl.[6] ..... B65B 9/00

[52] U.S. Cl. ..... 53/450; 53/416; 53/550; 53/128.1

[58] Field of Search ..... 53/410, 128.1, 53/133.4, 139.2, 550, 568, 450, 416

[56] References Cited

U.S. PATENT DOCUMENTS

| | | | |
|---|---|---|---|
| 4,558,556 | 12/1985 | Jostler | 53/459 |
| 4,744,674 | 5/1988 | Nocek | 53/410 |
| 4,756,144 | 7/1988 | Jostler | 53/568 |
| 4,774,797 | 10/1988 | Colamussi et al. | 53/568 |
| 4,812,074 | 3/1989 | Ausnit et al. | 53/133.4 |
| 4,832,505 | 5/1989 | Ausnit et al. | 53/410 |
| 4,945,714 | 8/1990 | Bodolay et al. | 53/139.2 |
| 5,036,643 | 8/1991 | Bodolay | 53/128.1 |

FOREIGN PATENT DOCUMENTS

| | | |
|---|---|---|
| 54564 | 9/1985 | European Pat. Off. . |
| 832874 | 2/1952 | Germany . |
| 433199 | 5/1984 | Sweden . |

*Primary Examiner*—Daniel Moon
*Assistant Examiner*—John Paradiso
*Attorney, Agent, or Firm*—Ladas & Parry

[57] ABSTRACT

A method and apparatus for forming and filling packages in which a flexible strip (10) of plastic material is folded in a central region, in a first station (1), to form a folded web (20) of two substantially opposed walls (21*a,b*) with first (22) and second (23) end regions disposed in the longitudinal direction of the web. In the first end region (22), the walls are interconnected with one another, and, in the second end region (23) the walls are separate from one another and provided with thickened material. In a second station (2) the web is formed with successively located storage pockets (26), and in a third station (3) the thickened material is engaged and the pockets (26) are opened so as to be filled with material, whereafter the pockets are closed.

14 Claims, 9 Drawing Sheets

METHOD AND AN APPARATUS FOR FORMING AND FILLING PACKAGES

FIELD OF THE INVENTION

The present invention relates to a method and an apparatus for forming and filling packages produced from plastic strip.

BACKGROUND

There is a need in this art for a method and an apparatus which makes it possible, starting from a strip of flexible plastic material, to form a web comprising a number of mutually subsequently disposed packaging pockets which are thereafter opened and filled with contents and, after closure, are suitable for transport to the consumer. Such an integrated technique makes it possible to eliminate storage and transport costs for prefabricated strips comprising packaging pockets, at the same time as a manufacturer of the material can simply reset the apparatus so that those packages which are formed in the web are adapted to the dimensions of the products which are to be packed.

Similarly, wishes have been expressed for a technique which makes it possible rationally to open and close such packages, and also efficiently to seal them after filling.

Patent specification DE 832 874 discloses a technique for forming and filling packages produced from a flexible strip of plastic material. Mechanical devices form out of this strip a web which is folded over in the longitudinal direction of the strip and is provided with transverse joints between which are formed storage pockets. The joints are disposed at a region which extends from the lower edge of the folded strip up towards the upper edge portion of the strip. In this relatively wide edge portion, the walls of the strip are movable in relation to one another so as to permit a mechanical filling device to be inserted between the walls. After the filling operation, a closed pocket is formed containing the contents, in that an L-shaped joint is provided along the upper edge of the strip with the catch of the joint connecting to the "counter current" located transverse joint of the filled package. Using scissor or shear devices, the filled packages are separated from the immediately following filled package.

Patent specification DE 832 874 does not disclose how the folded strip is held in the correct position during its displacement between the stations included in the apparatus. The folder plate 6 and subsequent slot 7 are passed by the strip in that the feeder rollers draw the strip over the folder plate and through the slot. Fusion of the walls by means of the hot jaws 10, severing of the joint 11 by means of the scissors 12, displacement of both strip walls through the jaw pair 23,24, displacement of the filled pocket to the position where the filled pocket is sealed by means of the jaws 16, which form an L-shaped weld along the upper edge of the pocket, with the "catch" connecting to the previously partially severed joint, and subsequent precision severing of the strip so that the incision is placed on the previously formed slot all take place without any description of how the strip is positioned transversely (horizontally and vertically).

Naturally, a controlled positioning of the web is necessary in particular on displacement of a filled package. Without such controlled positioning of the web, it is not possible to achieve a reliable and satisfactory function of the apparatus and requisite quality of the finished package. The present invention proposes a technique where such requirements are satisfied.

Patent specification EP 0 054 564 describes a technique in which a web with mutually subsequently disposed, finished packaging blanks are displaced in an apparatus which fills the packaging blanks with their contents and thereafter seals the blanks. On the other hand, this patent specification describes no technique which starts with a strip for producing in one and the same apparatus the packaging blanks and, by sealing of the filled packaging blanks, for forming filled packages.

Thus, patent specification EP 0 054 564 provides no solution to the problem posed here, namely that of producing the packaging blanks in one and the same apparatus starts with a strip of packaging material (plastic material), filling such blanks with their contents and finishing the packages by sealing the filled packaging blanks.

SUMMARY OF THE INVENTION

The present invention relates to a method and an apparatus in which the above outlined wishes and requirements are satisfied. This is attained by means of a method and an apparatus in which thickened portions are disposed in the longitudinal direction of the strip at or near the edges thereof and the thickened portions travel in respective guide channels.

The present invention provides the advantage that stock-keeping of packaging blanks is simplified and cost is reduced for producers of a certain type of goods. The apparatus in itself also accommodates the possibilities of simple adjustment for adaptation of the size of the packages to varying requirements. Stock-keeping of packaging material is simplified and reduced in cost, since such stock-keeping is limited to a number of reels of strip (as a rule of plastic material), possibly possessing different material properties and dimensions adapted to those products which are to be packed. Moreover, the present invention entails a simplification of the packaging work, including simplification of the purchase of packaging blanks/packaging material.

BRIEF DESCRIPTION OF THE DRAWINGS

The present invention will now be described in greater detail, with reference to the Drawings, in which.

DETAILED DESCRIPTION OF PREFERRED EMBODIMENTS

Figure 1A:
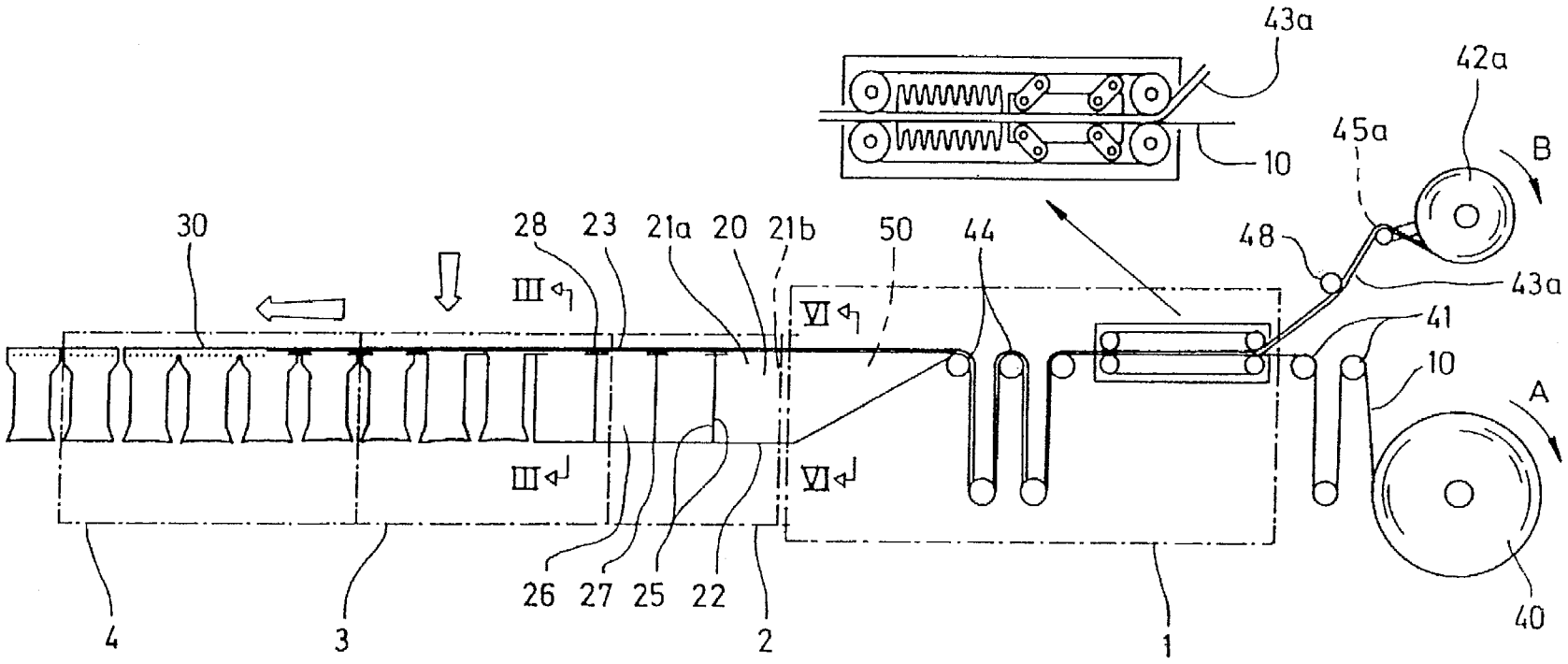
FIG. 1*a* is a schematic side elevation of a first embodiment of an apparatus according to the invention.

In the Figures there is shown a magazine reel 40 for a strip 10 of flexible plastic or similar material. The term "similar material" is taken to signify any material possessing such properties that a strip of the material is suitable for use in practical application of the present invention as described herein. The reel is journalled for rotation in the direction of the arrow A. From the magazine reel, a section of the strip 10 is drawn out which, via balance and bending rollers 41, as a rule spring-biased, such rollers, continues to a first station 1 provided for forming the strip into a folded web 20.

Figure 2A:
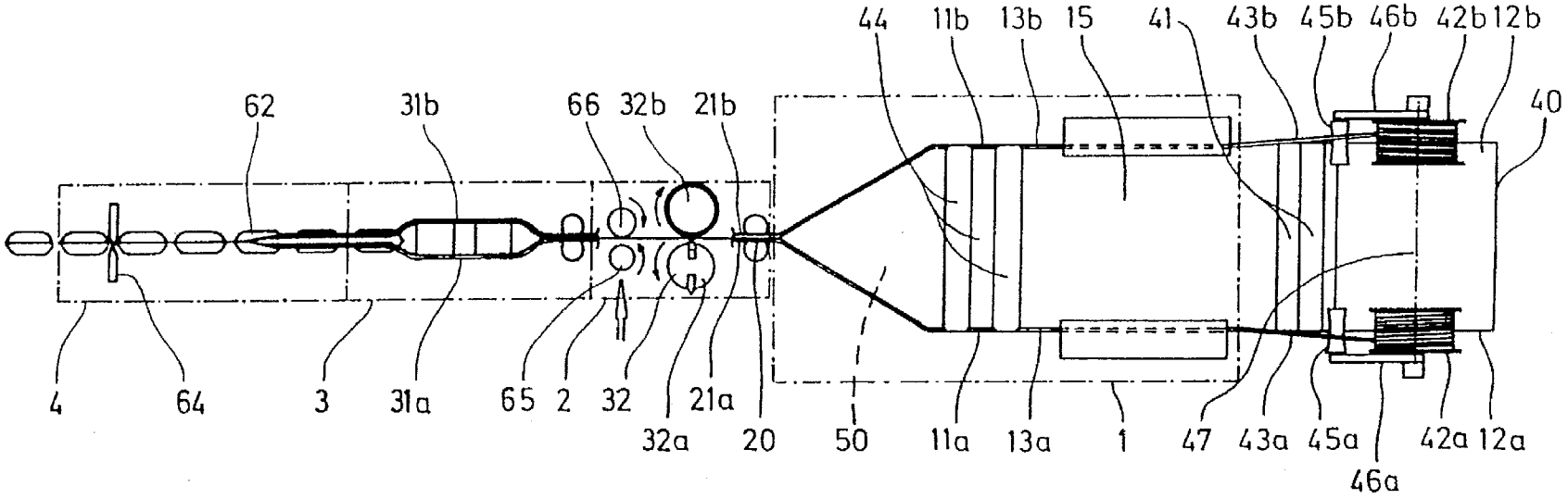
FIG. 2*a* is a top plan view of the first embodiment according to FIG. 1*a*.

FIGS. 1*a* and 2*a* show one embodiment of the present invention according to which magazine reels 42*a*,42*b* with rolled threads 43*a*, 43*b* of plastic or similar material are disposed to rotate in the direction of the arrow B while the threads are unwound. After unwinding, each one of the threads passes to the first station 1 in which they are fixed to the longitudinal side edges of the strip 10. After fixing at the side edges of the strip, the threads form thickened material portions 13*a*,13*b* comprising material from the threads and from the strip.

After unwinding from the magazine reels 42*a,b* each one of the threads 43*a,b* passes a support roller 45*a,b* which is movable in spring-return fashion substantially transversely of the threads. The support roller absorbs and evens out those tensions which occur in the threads as they are unwound and paid out. In the Figures, each respective support roller is shown as movably journalled in arms 46*a,b* which, in turn, are journalled in the region of the center shaft 47 of the magazine reels 42*a,b* for the threads. In the Figures, one embodiment has been shown in which a separate support roller 45*a,b* is provided for each one of the threads 43*a,b*. In certain practical applications, use is made of a common support roller 45 for both threads. In such instance, a return springing guide roller 48 is generally employed for each of the threads to keep the tension in the threads (the tensile force in the direction of the thread) within a predetermined range. As a rule, each respective guide roller 48 is disposed in association with that region where the threads pass into the first station 1.

It is evident that the illustrated return sprung journalling of the support rollers 45*a,b* constitutes but one example of suitable design of the apparatus. In addition, parts for journalling both the magazine reels of the threads and the magazine reel of the strip have been omitted from the Figures. As a rule, two mutually spaced apart journals are employed for this purpose for each magazine reel, the journals supporting a mechanical center shaft connected to each respective magazine reel.

The first station 1 is followed by a second station 2 in which storage pockets 26 are formed in the folded web which had been formed from the strip in the first station.

The second station 2 is followed by a third station 3 in which the formed storage pockets 26 are opened so as to make possible infeed of contents to the pockets, whereafter the pockets are closed.

The apparatus generally also includes a fourth station 4 in which the pockets filled with contents are sealed, this normally being effected by a welding process. The pockets filled with their contents are also generally separated from one another whereby separate, closed packages are formed.

Figure 1B:
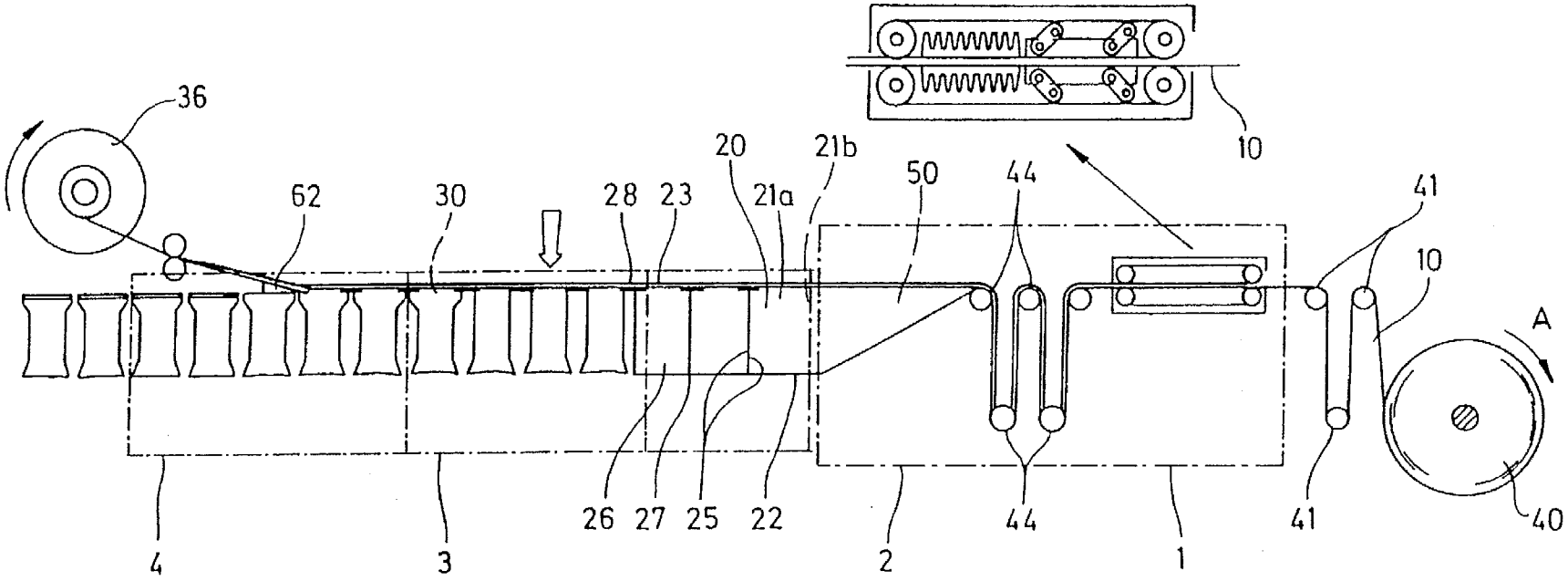
FIG. 1*b* is a schematic side elevation of a second embodiment of an apparatus according to the invention.

FIGS. 1 and 2 also show means for the possible supplementary treatment of the strip filled with contents.

The first station 1 also includes balance and bending rollers 44 for transferring the strip provided with thickened material portions to the second station 2. At least one or some of these balance and bending rollers 44 are returnably displaceable substantially at right angles to the transverse direction of the web and are arranged in a manner corresponding to that described above for the balance and bending rollers 41 for the threads 43*a,b*.

Most proximal the second station, the first station is provided with a guide member 50 (cf. also FIGS. 3*a* and 6*a,b*) disposed for folding together the strip to form a web 20 with two substantially opposing walls 21*a*,21*b*.

Figure 6B:
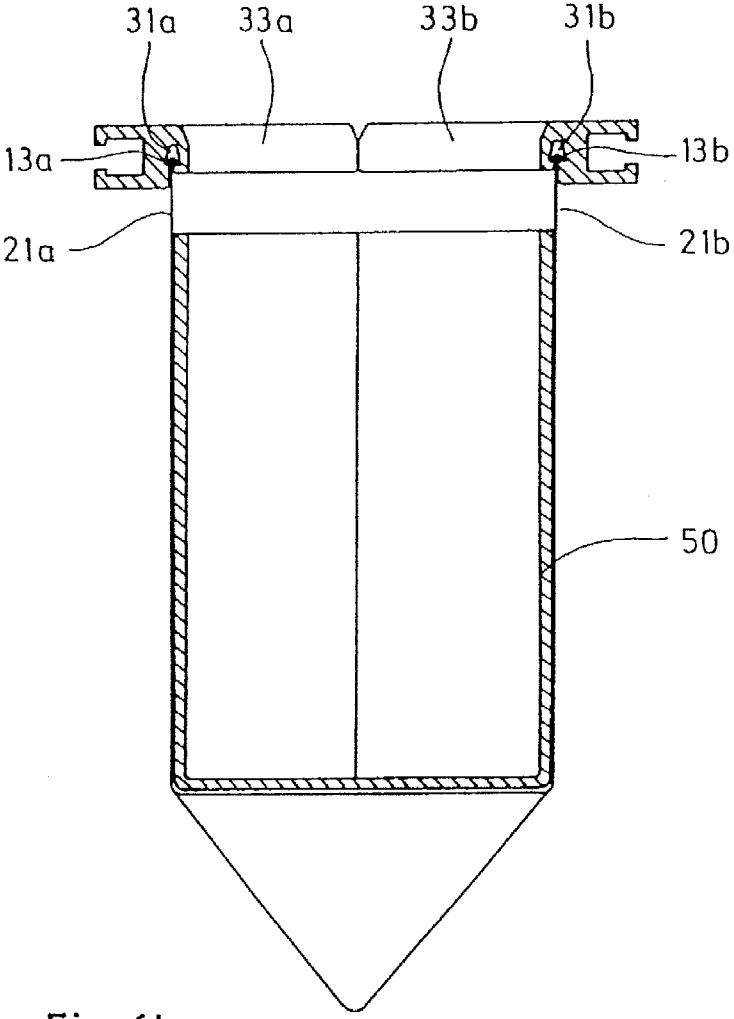
FIGS. 6*a*,*b* is a cross section taken along the line VI—VI in FIG. 1.
Figure 6A:
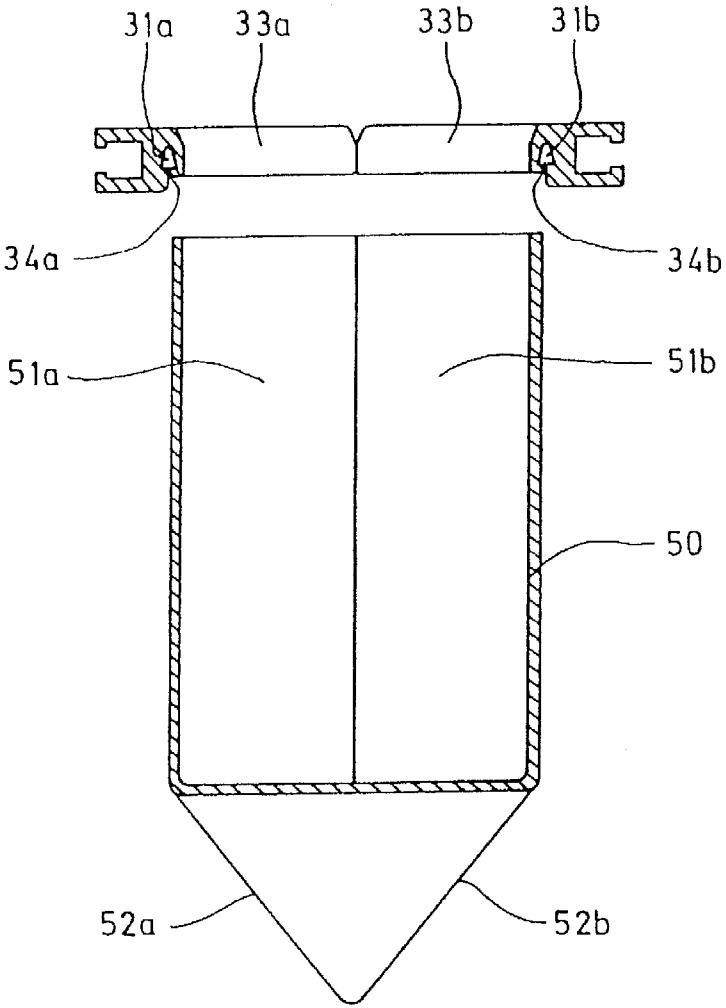

FIGS. 6*a* and 6*b* show in detail one embodiment of the guide member 50, where the cross section of the guide member forms two substantially parallel guide surfaces 51*a,b*. The guide surfaces are located in spaced apart relationship from one another in the infeed end of the guide member 50 and are, as a rule, located adjacent one another in the discharge end of the guide member. At the bottom in the Figure, the guide surfaces are united by means of a V-shaped surface 52*a,b* over which the central portion 15 of the strip 10 passes on folding together of the strip. The guide member cooperates with mechanical devices 33*a,b* (cf. FIG. 3*b*) each one including channels 31*a,b* dimensioned to accommodate the thickened portions 13*a,b* of the strip 10 formed by the threads 43*a,b*, in addition to adjacent portions of the strip. Each one of the channels 31*a,b* is provided with a longitudinal gap 34*a,b* whose maximum extent in the transverse direction is less than the width of the thickened portion 13*a,b* of each respective wall 21*a,b*. Most distal from the second station, i.e. where folding of the strip is commenced, the vertical sides are at their shortest. They are extended continually in a direction towards the second station, at the same time as the sides continually approach one another. On entry into the second station, the sides are located adjacent one another in one preferred embodiment.

In an alternative embodiment, the guide member 50 is designed as a rod one end of which is disposed in a region of the last balance and bending roller 44 or is located after the balance and bending roller in the direction of displacement of the strip. The rod is placed centrally in the direction of displacement of the strip and at an oblique angle downwards in FIG. 1. Its lower portion is curved in order that the strip is not damaged when it departs from the guide member. The lower portion is placed at a vertical distance from the channels 31*a,b* of the mechanical devices 33*a,b* which substantially corresponds to one-half of the distance between the thickened portions 13*a,b* of the strip.

The folded web formed with the aid of the guide member 50 has a first (lower) end region 22 disposed in the longitudinal direction of the web and a second (upper) end region 23 which is also disposed in the longitudinal direction of the web. In the first end region, the opposing walls 21*a,b* are interconnected with one another, while, in the second end region, the walls comprise first and second edge regions 24*a*,24*b* provided with thickened material portions 13*a,b*. The first and second edge regions 24*a,b* form free portions of the walls, i.e. the first and second edge regions are movable in relation to one another.

Figure 3C:
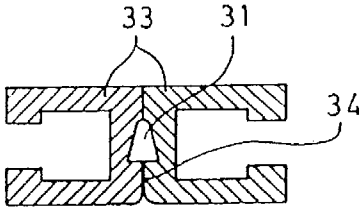
FIG. 3*c* is a cross section taken along the line III—III in FIG. 1 showing an alternative embodiment of the mechanical devices.
Figure 3B:
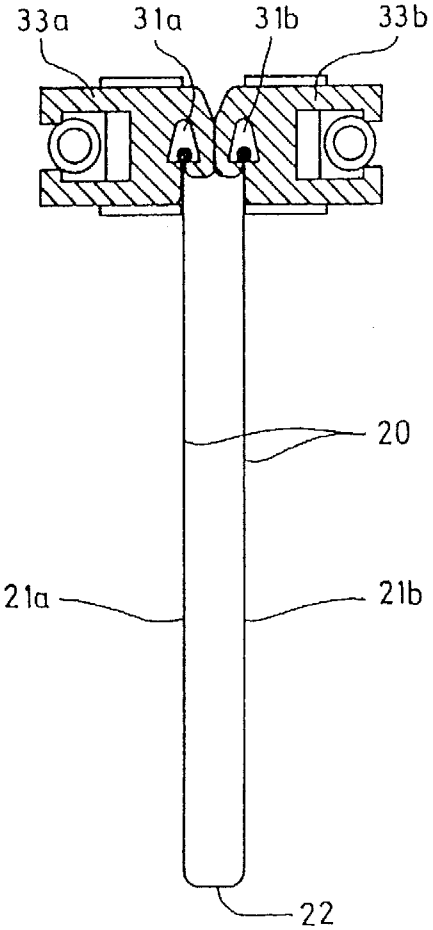
FIG. 3*b* is a cross section through the apparatus taken along the line III—III in FIG. 1 including the mechanical devices embodied in the apparatus.
Figure 3A:
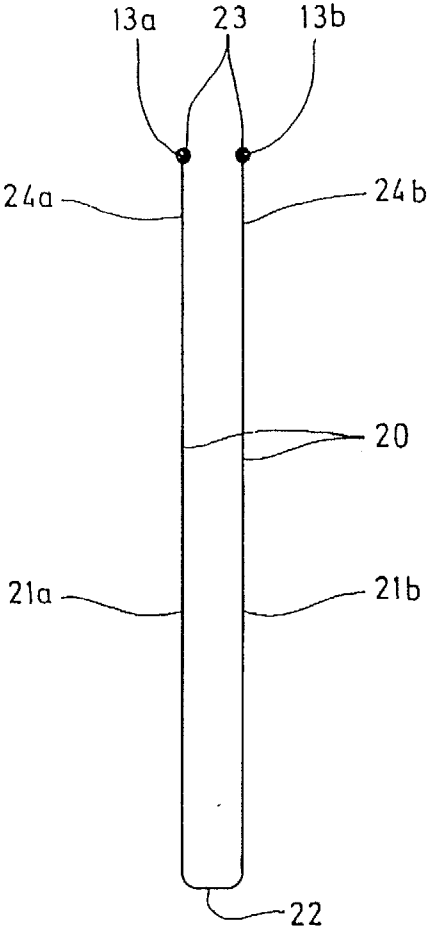
FIG. 3*a* is a cross section through the packaging web taken along the line III—III in FIG. 1 with the devices included in the apparatus having been omitted.
Figure 5A:
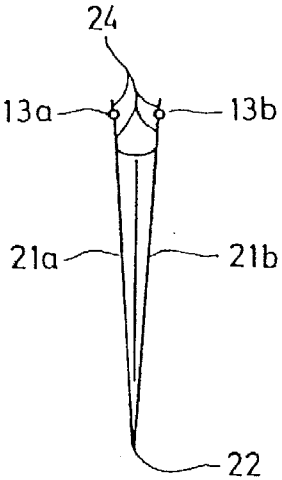
FIGS. 5*a*,*b* is a cross section taken along the line V—V in FIGS. 4*a* and 4*b*, respectively.
Figure 5B:
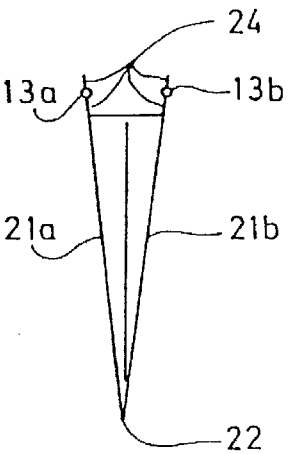

The second, third and fourth stations 2,3 and 4 are each provided with the mechanical devices 33*a,b* (cf. FIG. 3*b*) including the channels 31*a,b* for receiving and guiding the thickened portions 13*a,b* of the web 20. FIG. 3*c* shows one embodiment of the guide member 33 where this merely consists of a single channel 31 which is common for both of the thickened material portions 13*a,b*. The mechanical devices position the thickened portions and thereby the edge regions 24*a,b* of the web in relation to one another.

The second station also includes joining devices, for example welding means (not shown in the Figures) for forming substantially transverse joints 25 between the walls 21*a*,21*b* of the web. Between the joints pockets 26 are formed, disposed one after another in the longitudinal direction of the web. The second station also includes means 32 for forming substantially transverse slots 27. The means 32 are, in one preferred embodiment, designed as two cooperating rollers 32*a,b* between which the strip passes. The one roller 32*a* is provided with cutting devices for forming the transverse slots 27. The second roller 32*b* constitutes an abutment roller. The slots are disposed in a region which extends from the lower edge of the strip up to, and in certain embodiment into, the edge regions 24*a,b*. The slots are disposed between mutually adjacent pockets. In certain embodiments, the slots are bridged by bridge-like connections (not shown in the Figures) which are dimensioned so as readily to be broken when the pockets need to be removed from one another. The technique discussed in this paragraph is well known to persons skilled in the art and occurs in many variations within this art.

Figure 2B:
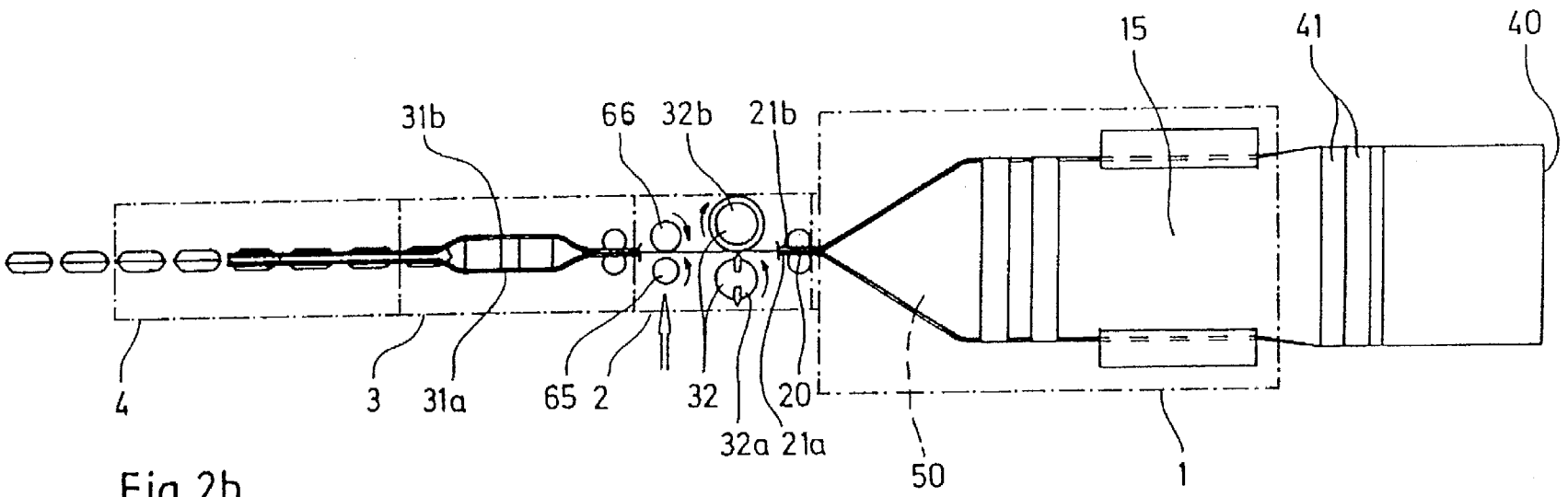
FIG. 2*b* is a top plan view of the second embodiment according to FIG. 1*b*.
Figure 4A:
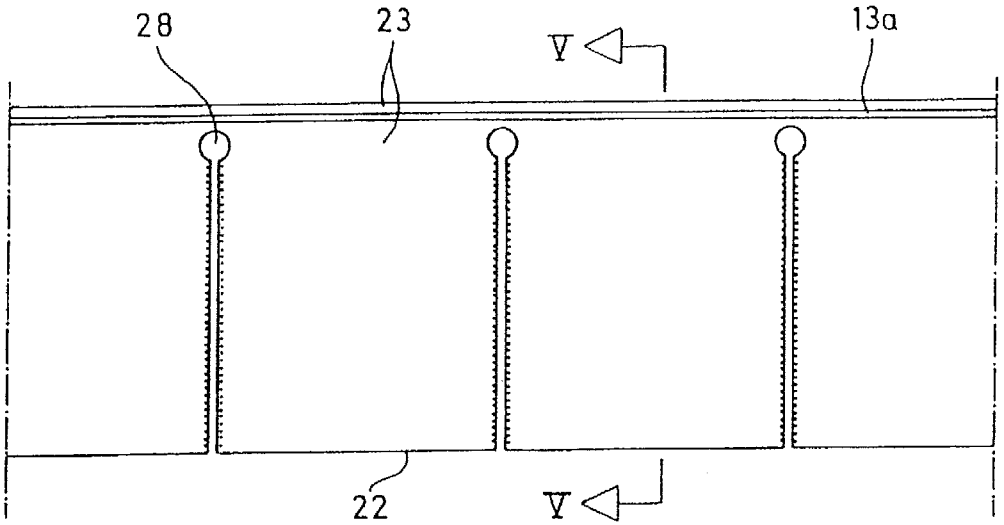
FIGS. 4*a*,*b* are side elevations of the packaging web in alternative embodiments.
Figure 4B:
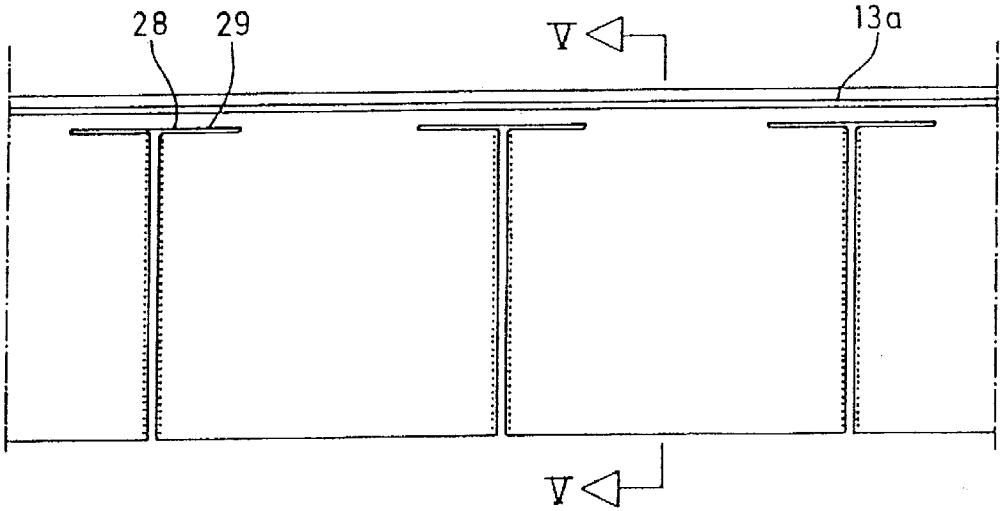

As shown in FIGS. 4*a* and 4*b*, a recess or hole 28 is generally provided in the upper terminal region of the transverse slot 27. The recess is disposed in the mouth portion of the pockets 26 and facilitates opening of the pockets. In those applications where a relatively large mouth opening of the pockets is required in connection with the introduction of contents, the transverse slot is terminated by a longitudinal slot 29 which is disposed on both sides of the transverse slot. Both of the slots together form a T. FIGS. 2*a* and 2*b* show a punching device 65 which cooperates with an abutment roller 66 for punching out the recesses 28 and/or the longitudinal slots 29.

In one alternative embodiment, the transverse slots are replaced by weakened portions in the material which are disposed in or between the transverse joints which define the pockets. When the mouth edges of the pockets are moved away from one another in connection with filling of the pockets, the connection in the weakened portions ruptures and equivalents of the previously described slots are formed.

In the third station 3, the mechanical device 33 is provided for moving the thickened portions 13*a,b* and thereby the edge regions 24*a,b* away from one another. To this end, the mechanical device is divided into two subdevices 33*a,b* which form one portion in the apparatus in which the channels 31*a,b* are located in spaced apart relationship from one another. When the thickened portions 13*a,b* pass this portion, the edge regions are moved away from one another and the packages are opened so as to make it possible to supply goods to the packages.

Figure 7:
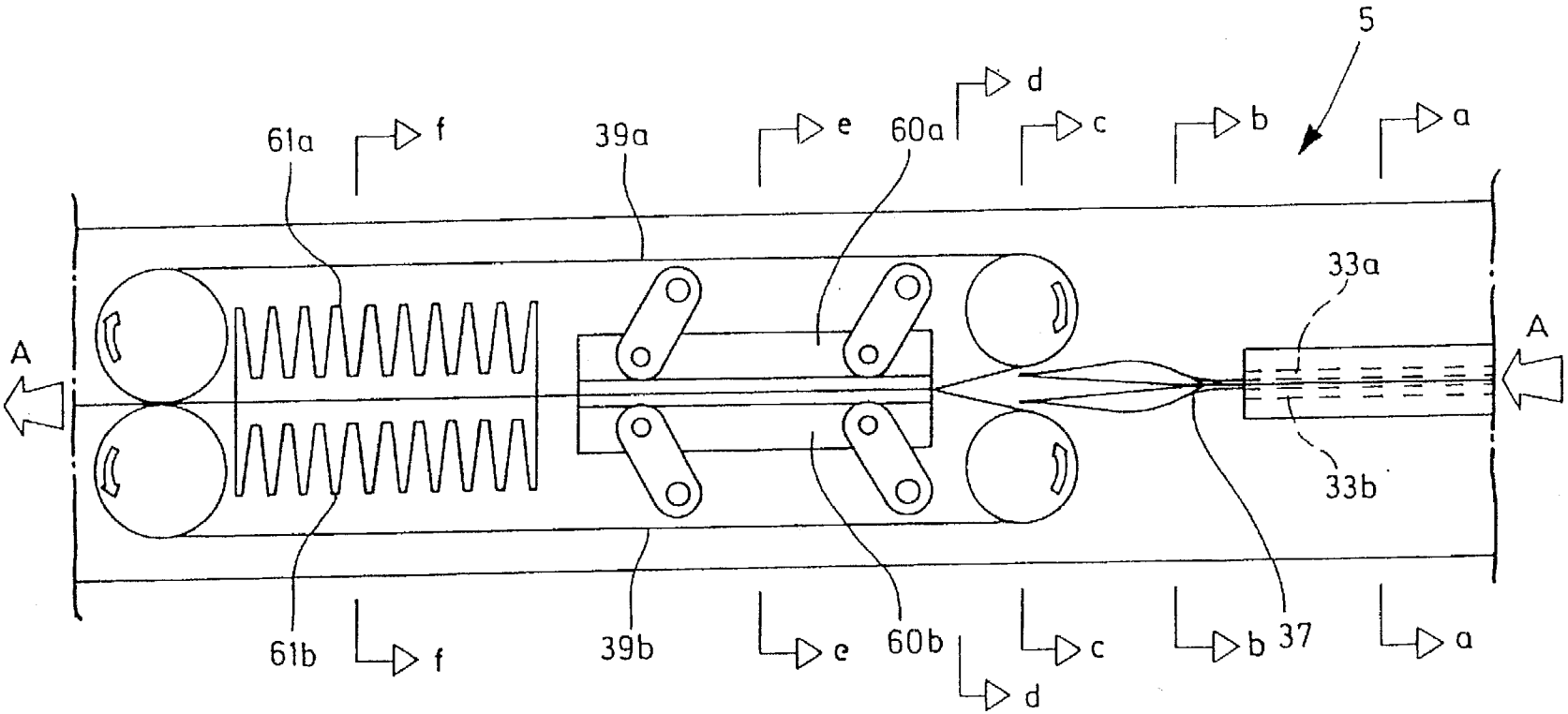
FIG. 7 shows one embodiment of a folding and sealing station of the apparatus.
Figure 7D:
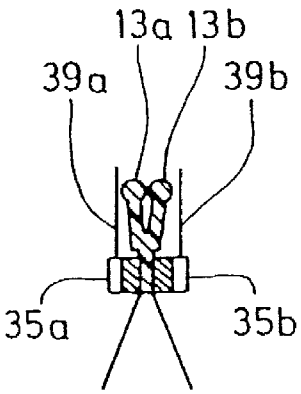
FIGS. 7*a–f* are sections taken along the lines A—A to F—F in FIG. 7.
Figure 7A:
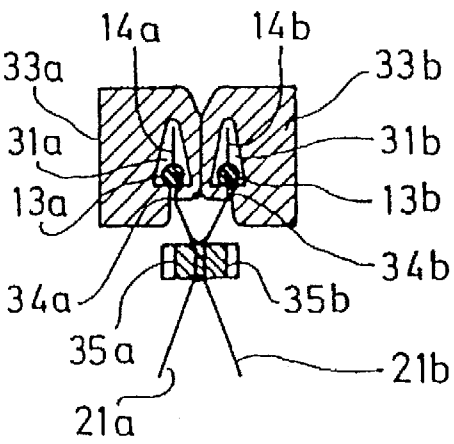
Figure 7E:
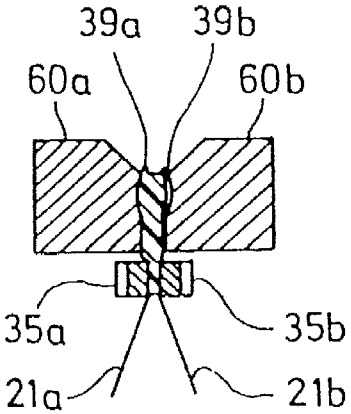

After this portion, the channels return to positions adjacent one another or merge into a single channel 31 common to both of the thickened portions. When the thickened portions pass into this region of the channels, the edge regions are placed adjacent one another whereby the walls of the pockets achieve a positioning which makes closure of the packages possible. This takes place in the subsequent, fourth station 4 in which the closure generally takes place in that a joining device 60*a,b*, for example a welding device (cf. FIGS. 7 and 7*e*) presses together—for example fuses together—the plastic material regions which are united in a joint 30. Joints formed by means of adhesive are also employed in alternative embodiments of the present invention. As required, the sealing joint 30 is placed on either side of the thickened portions 13*a,b*. In embodiments in which the sealing joint is disposed beneath the thickened portions, it generally extends from one transverse joint 25 of the pocket 26 to the other transverse joint 25 of the pocket.

In certain practical applications, use is made of a mechanical device 62 which is operative, once the pockets have been sealed, to cut off that part of the edge region 24*a,b* which is located most proximal the second (upper) end region 23 of the web. The packages are hereby trimmed and packaging material which is cut off is wound up onto a magazine reel 36. As a rule, the severance is disposed flush with the recesses 28 of the web, and in particular when the recesses are designed as longitudinal slots 29.

In certain embodiments, the closure (the welding together) takes place above the thickened portions. In this embodiment, the thickened portions are, in certain practical applications, designed with grooves or beads, respectively, fitting in one another and designed such that the bead is fixedly retained in the groove once it has been inserted therein. Wastage is hereby eliminated on manufacture and filling, in addition to which the possibility is afforded, in those applications in which the thickened portions are designed with fitting male and female portions, of reclosing an opened package which has only partly been emptied of its contents.

Figure 5C:
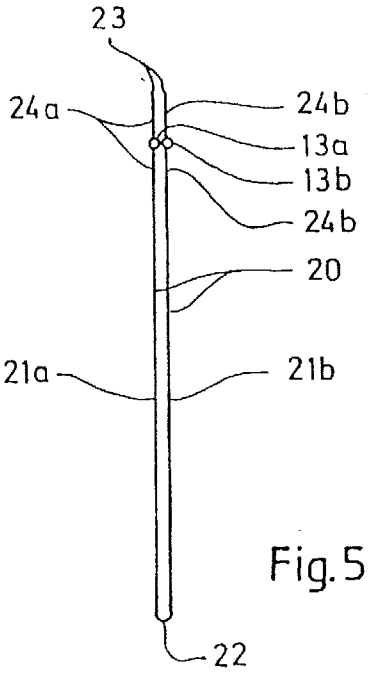
FIG. 5*c* is a cross section through a folded strip.

FIG. 5*c* shows one embodiment of the strip where it is provided with material thickened portions 13*a,b* in its edge regions when delivered. The strip is, in addition, folded in the longitudinal direction of the strip in a portion disposed centrally in the longitudinal direction of the strip. The thickened portions of the strip are thereby located adjacent one another and the strip forms a web 20 displaying a design which corresponds to that previously described (cf. FIGS. 3*a* and 3*b*). In this instance, the web is preferably fed into station 2 of the apparatus with the guide member 50 bypassed. The distance between the balance and bending rollers 44 and the mechanical devices 33 of the second station with the channel 31 is then selected to be so great that the web can manage the requisite change of approximately 90° of the orientation of the walls of the web.

When the web is delivered in one version in which the thickened portions are absent but in which the web has been folded double, the distance between the magazine reel 40 for the strip and the first station 1 of the apparatus is selected to be sufficiently long so that the strip has time to be folded completely before passing into the first station in order to be provided thereat with the thickened material portions 13*a,b* applying the technique described in the foregoing.

FIGS. 7,7*a–f* show one embodiment of the present invention in which the wall portions 14*a,b* projecting above the thickened material portions are employed, on closure of the packages, to cover the longitudinal slots 29 of the web. To this end, the fourth station (the closure station) 4 is provided with a folding device 37 which progressively displaces the wall portions 24*a,b* located outside the thickened portions in an outward and downward direction so that they are brought to positions overlapping the longitudinal slot 29. In one region of the web located beneath that edge portion which is affected by the joint in the process of being formed, drive means 35*a,b* such as, for example, cogged belts 35*a,b* hold the web between themselves and displace the web through the closure device. The folding device 37 is shown in FIG. 7,7*a–f* in one embodiment in which it includes two abutment surfaces 38*a,b* which are substantially vertically oriented.

Figure 7B:
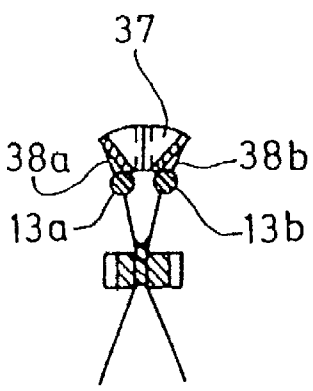
Figure 7F:
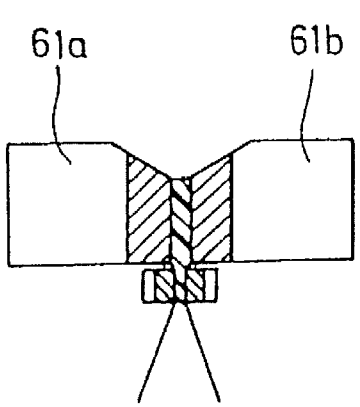
Figure 7C:
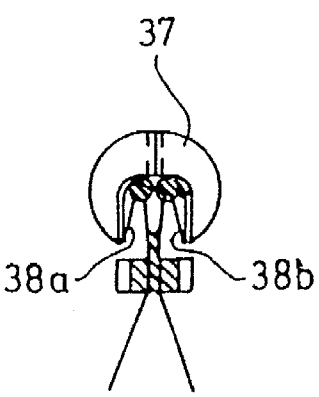

The wall portions 14*a,b* are moved on either side of both of the substantially vertically disposed abutment surfaces 38*a,b* (cf. FIG. 7*b*). The abutment surfaces have helical form and turn substantially one-half a revolution in order, during the movement of the wall portions, to guide these to the positions illustrated in FIG. 7*c*. The wall portions are thereafter brought together in order to be fused together by the welding jaws 60*a,b* described below. The strip is held in place by two cogged belts 63*a,b* which therebetween fix both walls of the strip and thereby press these towards one another. The displacement of the cogged belts is synchronized with the displacement of the web 20 realized by the above-described drive means 35*a,b*.

Joining belts 39*a,b* of heat resistant material such as, for example TEFLON are thereafter brought by welding devices 60*a,b* into abutment against the folded material portions 14*a,b* and, in the illustrated embodiment, the joining belts of the web urge against the walls of the packaging strip in the region beneath the thickened portions 13*a,b*. In one preferred embodiment, the folded material portions cover the longitudinal slots 29. It is obvious that, in other embodiments, the walls of the web are welded or fused together above the thickened portions 13*a,b* below the longitudinal slots 29 or within any other region whatever whose position is chosen in response to the relevant design of the web and the desired design of the filled package.

Once the welding has been completed, the welding joint is cooled by means of a cooling device 61*a,b*, for example designed as cooling jaws which are disposed to abut under pressure against and cool the welding joint. The package is thereafter finished.

In certain embodiments, a cutting device 62 cuts away the thickened portions 13*a,b* from the web when the sealing weld is located beneath the thickened portions 13*a,b*. As a rule, the welding device is designed so that the severing takes place by compression of the still warm material in the welding joint. In such instance, the compression takes place, in one preferred embodiment above that region which includes the longitudinal slots 29 covered by the folded material portions 14*a,b*. The filled packages are generally separated from one another once they have been finished. This is effected by means of special separators 64 which realize separation of the finished package, for example by a punching process.

In yet a further embodiment, the apparatus includes means for providing the strip 10 with two parallel and mutually spaced thickened portions 13*a,b* in the region of each edge of the strip.

In still a further embodiment, the apparatus is designed to produce a packaging strip in which the packages formed from the packaging strip include a gripping device, as a rule designed as a thickened portion in connection with its bottom region. This is achieved in that, for example, a thickening strip is welded in place in the longitudinal direction of the web centrally in the web before this is folded together.

In certain practical applications of the present invention, use is made of a strip 10 which is already provided with the thickened portions 13*a,b* before the strip is fed into the apparatus. It will be obvious that this practical application dispenses with the devices 42,45,48 (cf FIGS. 1*b*,2*b*) described in connection with the first station for applying the thickened portions (the threads) to the station and the devices for fixing the thickened portions to the strip.

It will further be obvious that the apparatus according to the invention operates, in certain embodiments with intermittent displacement of the strip or the packaging web formed from the strip. In other embodiments of the apparatus, the apparatus displaces the strip or web, respectively, continuously through the apparatus.

The foregoing description has occasionally employed the designations upper, lower, right, left, etc. These designations have been employed so as to facilitate presentation of the invention. However, it will be obvious to a person skilled in the art that the described technique generally permits an optional orientation of the web in space.

The above detailed description has referred to but a limited number of embodiments of the present invention, but a person skilled in the art will readily perceive that the present invention accommodates a large number of embodiments without departing from the spirit and scope of the appended claims.

What is claimed is:

1. A method of forming and filling packages comprising:

longitudinally advancing a folded strip of material having opposite longitudinal edges at which thickened material is provided, said folded strip of material being longitudinally advanced with the thickened material in confronting relation form a web with an open, upper end, a closed lower end and opposite walls, sealing the web along longitudinally spaced, transverse joints, at which said walls are joined together to produce successive pockets along the web, the transverse joints extending from the closed, lower end of the web upwardly towards the upper end with the thickened material thereat, forming lines of weakness at said joints extending from said lower end towards said upper end, forming recesses in said walls at upper ends of said lines of weakness and below said thickened material at said upper end of the web, opening the pockets of the web at said open, upper end of the web by engaging the thickened material thereat and guidably moving the edge with said thickened material away from one another as said web undergoes longitudinal advance, introducing a substance into the now open pockets as said pockets advance past a filling station, closing and sealing said pockets by engaging said thickened material at the upper end of the web and guidably moving the thickened material of the two walls into contact with one another, and joining said thickened material at the two walls to one another to form packages containing said substance.

2. A method as claimed in claim 1, comprising longitudinally advancing said strip of material in a flat state and folding said strip of material as the strip of material is being longitudinally advanced to bring said edges with the thickened material into confronting relation and form said folded strip of material.

3. A method as claimed in claim 2, wherein said strip is in the form of a sheet, and said sheet is folded along a fold line midway between said longitudinal edges.

4. A method as claimed in claim 2, wherein said lines of weakness are formed by slots located in said transverse joints.

5. A method as claimed in claim 4, wherein said slots extend into said recesses.

6. A method as claimed in claim 2, wherein said recesses are formed as longitudinal slots connected to said lines of weakness.

7. A method as claimed in claim 2, comprising separating said packages from one another after said pockets have been closed and sealed.

8. A method as claimed in claim 2, comprising supplying separate threads of material for advance with said flat strip at said opposite longitudinal edges of said strip and joining said threads to said strips to form said thickened material at said longitudinal edges.

9. A method as claimed in claim 2, wherein said recesses are formed as circular holes at ends of said lines of weakness.

10. Apparatus for forming and filling packages comprising:

means for longitudinally advancing a folded strip of material having opposite longitudinal edges at which thickened material is provided, said folded strip of material having said edges with the thickened material in confronting relation and forming a web with an open, upper end, a closed lower end and opposite walls, means for sealing the web along longitudinally spaced, transverse joints, at which said walls are joined together to produce successive pockets along the web, the transverse joint extending from the closed, lower end of the web upwardly towards said upper end at which the thickened material is disposed, means for forming lines of weakness at said joints extending from said lower end towards said upper end, means for forming recesses in said walls at upper ends of said lines of weakness and below said thickened material at the upper end of the web, means for opening the pockets of the web at said open, upper end of the web including guides for engaging the thickened material thereat and guidably moving the thickened material away from one another as said web undergoes longitudinal advance, means for introducing a substance into the now open pockets as said pockets advance past a filling station, means for closing said pockets by guidably moving the thickened material of the two walls into contact with one another, and means for then joining said thickened material at the two walls to one another to form packages containing said substance.

11. Apparatus as claimed in claim 10, wherein said means for longitudinally advancing a folded strip of material comprises means for longitudinally advancing said strip in a flat state, and folding means for folding said strip of material as said strip of material is longitudinally advancing to bring said edges with the thickened material into confronting relation and form said folded strip of material.

12. Apparatus as claimed in claim 11, wherein said guides comprise channels in which said thickened material is guidably supported, said walls of said web extending through gaps provided in said guides dimensioned such that the walls of the web pass through said gaps whereas said thickened material remains in said channels and thereby said walls of the web are suspended by the thickened portions in said channels.

13. Apparatus as claimed in claim 12, wherein said means for forming said lines of weakness comprises cutting means for forming said lines of weakness as slots located in said transverse joints and extending into said recesses.

14. Apparatus as claimed in claim 10, comprising reels for supplying separate threads of material along with said flat strip at said opposite longitudinal edges of said strip and means for joining said threads to said strip to form said thickened material at said longitudinal edges.

* * * * *